US009715812B2

(12) United States Patent
Hita

(10) Patent No.: US 9,715,812 B2
(45) Date of Patent: Jul. 25, 2017

(54) MOTOR-DRIVEN SCREWDRIVER OPERATION INFORMATION INDICATOR AND MOTOR-DRIVEN SCREWDRIVER WITH OPERATION INFORMATION INDICATING FUNCTION

(71) Applicant: NITTO KOHKI CO., LTD., Tokyo (JP)

(72) Inventor: Hirokazu Hita, Tokyo (JP)

(73) Assignee: NITTO KOHKI CO., LTD., Tokyo (JP)

( * ) Notice: Subject to any disclaimer, the term of this patent is extended or adjusted under 35 U.S.C. 154(b) by 0 days.

(21) Appl. No.: 15/096,457

(22) Filed: Apr. 12, 2016

(65) Prior Publication Data

US 2016/0225247 A1 Aug. 4, 2016

Related U.S. Application Data

(63) Continuation of application No. PCT/JP2014/077909, filed on Oct. 21, 2014.

(30) Foreign Application Priority Data

Oct. 22, 2013 (JP) ..... 2013-219432

(51) Int. Cl.
*G08B 21/00* (2006.01)
*G08B 21/18* (2006.01)
(Continued)

(52) U.S. Cl.
CPC ..... *G08B 21/18* (2013.01); *B25B 21/00* (2013.01); *B25B 23/00* (2013.01); *B25B 23/147* (2013.01); *B25F 5/00* (2013.01); *G08B 5/36* (2013.01)

(58) Field of Classification Search
CPC ..... B25B 23/00; B25F 1/00
(Continued)

(56) References Cited

U.S. PATENT DOCUMENTS 4,483,072 A 11/1984 Nagashima et al.
5,894,095 A 4/1999 DeMali
(Continued)

FOREIGN PATENT DOCUMENTS

CN 1470364 1/2004
DE 32 36 478 2/1984
(Continued)

OTHER PUBLICATIONS

English Translation of First Office Action issued Jan. 11, 2017 in corresponding Chinese Application No. 201480058156.3.
(Continued)

*Primary Examiner* — Toan N Pham
(74) *Attorney, Agent, or Firm* — Wenderoth, Lind & Ponack, L.L.P.

(57) ABSTRACT

A motor-driven screwdriver operation information indicator is retrofittable to a motor-driven screwdriver to indicate information related to an operation of the motor-driven screwdriver. An indicator housing of the operation information indicator is secured to a supporting and securing member configured to be secured to an outer peripheral surface of a screwdriver housing of the motor-driven screwdriver, thereby holding the indicator housing at a rear position of a rear end portion of the motor-driven screwdriver. An indication control circuit disposed in the indicator housing is connected to at least one of a motor-driven screwdriver drive control circuit and an external control circuit to receive a signal from the circuit connected thereto. The indication control circuit transmits a signal related to an operation of the motor-driven screwdriver on the basis of the received
(Continued)

signal and indicates information related to the operation of the motor-driven screwdriver on an operation information indicating part.

13 Claims, 9 Drawing Sheets

(51) Int. Cl.

| | |
|---|---|
| ***B25F 5/00*** | (2006.01) |
| ***B25B 21/00*** | (2006.01) |
| ***B25B 23/147*** | (2006.01) |
| ***B25B 23/00*** | (2006.01) |
| ***G08B 5/36*** | (2006.01) |

(58) Field of Classification Search
USPC ... 340/679, 680, 691.1, 691.6, 693.5, 693.9; 7/107, 108, 165; 362/119, 120, 800
See application file for complete search history.

(56) References Cited

U.S. PATENT DOCUMENTS

| | | | | |
|---|---|---|---|---|
| 7,613,590 | B2 * | 11/2009 | Brown | A61B 5/0002 340/500 |
| 2002/0144832 | A1 | 10/2002 | Brandstrom et al. | |
| 2004/0007370 | A1 | 1/2004 | Giardino | |
| 2009/0013477 | A1 * | 1/2009 | Agronin | B25B 7/00 7/107 |
| 2010/0315804 | A1 * | 12/2010 | Nishikimi | B25F 5/021 362/119 |

FOREIGN PATENT DOCUMENTS

| | | |
|---|---|---|
| EP | 1 439 035 | 7/2004 |
| JP | 59-17902 | 2/1984 |
| JP | 6-83272 | 11/1994 |
| JP | 9-76166 | 3/1997 |
| JP | 2007-111796 | 5/2007 |
| JP | 5078855 | 9/2012 |
| JP | 2013-71219 | 4/2013 |

OTHER PUBLICATIONS

International Search Report issued Jan. 6, 2015 in International (PCT) Application No. PCT/JP2014/077909.
Extended European Search Report issued May 17, 2017 in corresponding European Application No. 14856178.0.

* cited by examiner

MOTOR-DRIVEN SCREWDRIVER OPERATION INFORMATION INDICATOR AND MOTOR-DRIVEN SCREWDRIVER WITH OPERATION INFORMATION INDICATING FUNCTION

TECHNICAL FIELD

The present invention relates to a motor-driven screwdriver operation information indicator indicating information related to an operation of a motor-driven screwdriver, and also relates to a motor-driven screwdriver with an operation information indicating function which has the motor-driven screwdriver operation information indicator. More specifically, the present invention relates to a motor-driven screwdriver operation information indicator retrofittable to a motor-driven screwdriver, and also relates to a motor-driven screwdriver with an operation information indicating function which has the motor-driven screwdriver operation information indicator retrofitted thereto.

BACKGROUND ART

There is known a motor-driven screwdriver having an indicating device that informs an operator about the drive status of the motor-driven screwdriver (Patent Literature 1). The known motor-driven screwdriver has a screwdriver body equipped with an LED indicating that the associated motor is being driven and another LED indicating a state where the motor has been stopped due to the generation of torque greater than a specified value, thereby enabling visual confirmation of the motor drive status.

Meanwhile, a production line for manufacturing a wide variety of products often requires using different tools for manufacturing products of different types. In such a production line, if an operator is left to make a judgment as to which tool should be used to make a particular product, he or she may mistakenly use an improper tool. To prevent such a judgment error, a tool management system has been developed in which a signal is sent to a tool to be used from a control circuit for controlling the operation in the production line (this kind of control circuit will hereinafter be referred to as an "external control circuit") to light up an LED provided in the tool, thereby informing the operator about the tool to be used (Patent Literature 2).

Not all users using a plurality of tools, e.g. motor-driven screwdrivers, demand the above-described information representing the motor drive status of a motor-driven screwdriver and information indicating which one of the tools should be used. Even if such information is demanded, pieces of information wanted to be indicated differ for each user in most cases. Therefore, in order to meet each user's individual demand, conventional practice is to manufacture a motor-driven screwdriver having a specific indicating function as a specially ordered product. There is also a case where a user wants to add an information indicating function to an already used motor-driven screwdriver afterwards. In such a case, an indicator may be retrofitted to the motor-driven screwdriver. However, motor-driven screwdrivers are available in many specifications and shapes; therefore, it is necessary, in order to retrofit an indicator to an existing motor-driven screwdriver, to manufacture an indicator conforming in shape to each individual motor-driven screwdriver.

CITATION LIST

Patent Literature

Patent Literature 1: Japanese Unexamined Utility Model Application Publication No. Hei6-83272
Patent Literature 2: Japanese Patent No. 5078855

SUMMARY OF INVENTION

Technical Problem

However, a complicated, time- and labor-consuming operation is required to add an information indicating function to a motor-driven screwdriver by the above-described method. Accordingly, it has been desired that the operation of adding an information indicating function to a motor-driven screwdriver should be made capable of being performed even more easily.

Accordingly, an object of the present invention is to provide a motor-driven screwdriver operation information indicator capable of being retrofitted to various existing motor-driven screwdrivers by an easy operation, and to provide a motor-driven screwdriver with an operation information indicating function which has the motor-driven screwdriver operation information indicator retrofitted thereto.

Solution to Problem

That is, the present invention provides a motor-driven screwdriver operation information indicator retrofittable to a screwdriver housing of a motor-driven screwdriver to indicate information related to an operation of the motor-driven screwdriver. The motor-driven screwdriver operation information indicator includes: a supporting and securing member configured to be secured to an outer peripheral surface of a rear end portion of the screwdriver housing; an indicator housing having a securing part to be engagingly secured to a supporting and securing part provided on the supporting and securing member, the indicator housing being held at a rear position of a rear end portion of the motor-driven screwdriver by securing the securing part to the supporting and securing part; an indication control circuit disposed in the indicator housing, the indication control circuit being connected to at least one circuit selected from between a motor-driven screwdriver drive control circuit disposed in the screwdriver housing and an external control circuit outside the screwdriver housing to transmit a signal related to an operation of the motor-driven screwdriver on the basis of a signal received from the at least one circuit; and an operation information indicating part configured to receive the signal related to the operation of the motor-driven screwdriver, which is transmitted from the indication control circuit, and to indicate information related to the operation of the motor-driven screwdriver.

In the motor-driven screwdriver operation information indicator of the present invention, the supporting and securing member is configured to be secured to the outer peripheral surface of the screwdriver housing of the motor-driven screwdriver, and the indicator housing having the indication control circuit disposed therein is engagingly secured to the supporting and securing member. Therefore, only the supporting and securing member needs to be formed in conformity with the shape of a motor-driven screwdriver to which the supporting and securing member is to be attached, and the indicator housing can be used in common for motor-driven screwdrivers of different configurations. Accordingly, the motor-driven screwdriver operation information indicator can be retrofitted to any of various motor-driven screwdrivers, provided that a supporting and securing member is prepared which conforms in shape to various motor-driven screwdrivers.

Preferably, the supporting and securing member may have a ring-like shape covering the outer peripheral surface of the screwdriver housing.

More preferably, the supporting and securing member may have an inner peripheral surface conforming in shape to the outer peripheral surface of the screwdriver housing.

With the supporting and securing member having the above-described configuration, the motor-driven screwdriver operation information indicator can be retrofitted to the motor-driven screwdriver even more firmly, and it is also possible to prevent dust, water, etc. from entering the indicator housing through a gap between the supporting and securing member and the motor-driven screwdriver.

Preferably, the securing part of the indicator housing and the supporting and securing part of the supporting and securing member may be fitted to each other in the axial direction of the supporting and securing member.

With the above-described structure, it is possible to prevent positional misalignment of the indicator housing relative to the supporting and securing member, particularly in the radial direction of the supporting and securing member. Accordingly, the position of the indicator housing relative to the supporting and securing member can be stabilized even more.

Preferably, the arrangement may be as follows. The rear end portion of the screwdriver housing is provided with a suspension hole for suspending the motor-driven screwdriver. The indicator housing has a through-hole extending through the indicator housing from the outer peripheral surface to the inner peripheral surface thereof. The motor-driven screwdriver operation information indicator further includes a connecting member inserted into the suspension hole through the through-hole to connect together the indicator housing and the rear end portion of the screwdriver housing.

Specifically, the arrangement may be as follows. The through-hole of the indicator housing has an internal thread, and the connecting member is an externally threaded member engageable with the internal thread.

By connecting the indicator housing to the screwdriver housing of the motor-driven screwdriver as stated above, the indicator housing can be prevented from coming off the motor-driven screwdriver even if the indicator housing should be dislodged from the supporting and securing member.

Preferably, the indicator housing may have a suspension hole for securing a suspension hook.

The suspension hook is, usually, attached to the rear end portion of the motor-driven screwdriver. In this regard, even when the suspension hook becomes unable to be attached to the motor-driven screwdriver due to the fact that the motor-driven screwdriver operation information indicator is retrofitted to the rear end portion of the motor-driven screwdriver, the suspension hook can be attached to the motor-driven screwdriver operation information indicator instead; therefore, the motor-driven screwdriver can be suspended from a predetermined position by using the suspension hook.

Preferably, the operation information indicating part may have a light-emitting display element that emits light upon receiving the signal related to the operation of the motor-driven screwdriver from the indication control circuit.

Because information related to the operation of the motor-driven screwdriver can be confirmed visually, it is possible to inform the operator of the information accurately even at a noisy worksite.

Specifically, the information related to the operation of the motor-driven screwdriver may be at least one of the following information: information indicating that the motor-driven screwdriver is usable, which is based on a signal transmitted from the external control circuit; information indicating the operating status of the motor-driven screwdriver; information indicating the timing of inspection and repair of the motor-driven screwdriver; and information indicating a state where the motor-driven screwdriver has been forcibly stopped.

Preferably, the indication control circuit may have a recording device for recording the signal received, which is related to the operation of the motor-driven screwdriver, and a data output terminal for transferring data represented by the signal recorded in the recording device to the outside.

By taking out and analyzing the recorded data, it is possible to understand the operator's operating status and to supervise whether or not the operator is working efficiently.

Preferably, the arrangement may be as follows. The indication control circuit is connectable to the motor-driven screwdriver drive control circuit. The motor-driven screwdriver operation information indicator further includes internal signal transmission wiring connected at one end thereof to the indication control circuit. The other end of the internal signal transmission wiring is connectable to the motor-driven screwdriver drive control circuit.

In addition, the present invention provides a motor-driven screwdriver with an operation information indicating function. The motor-driven screwdriver includes a motor-driven screwdriver, and the above-described motor-driven screwdriver operation information indicator retrofitted to a screwdriver housing of the motor-driven screwdriver.

Embodiments of a motor-driven screwdriver operation information indicator and a motor-driven screwdriver with an operation information indicating function according to the present invention will be explained below on the basis of the accompanying drawings

DESCRIPTION OF EMBODIMENTS

Figure 1:
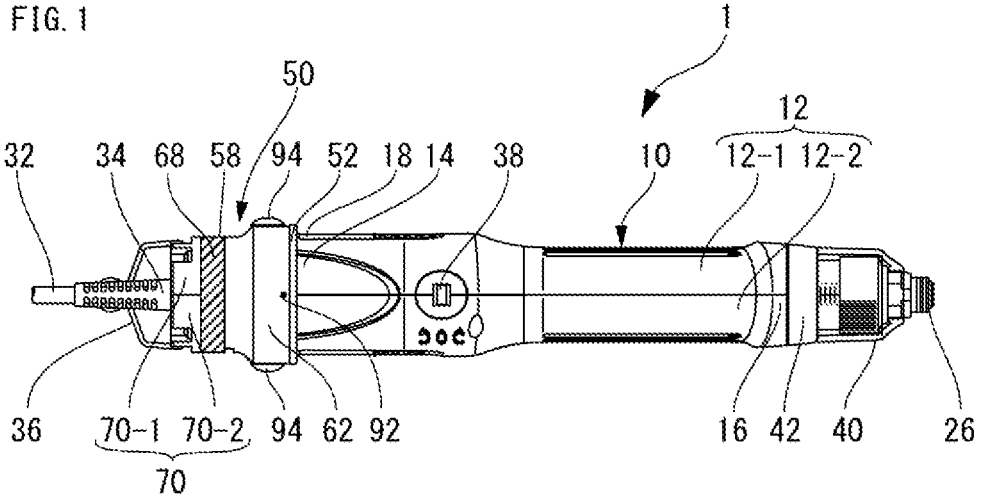
FIG. 1 is a top view of a motor-driven screwdriver with an operation information indicating function according to the present invention.
Figure 2:
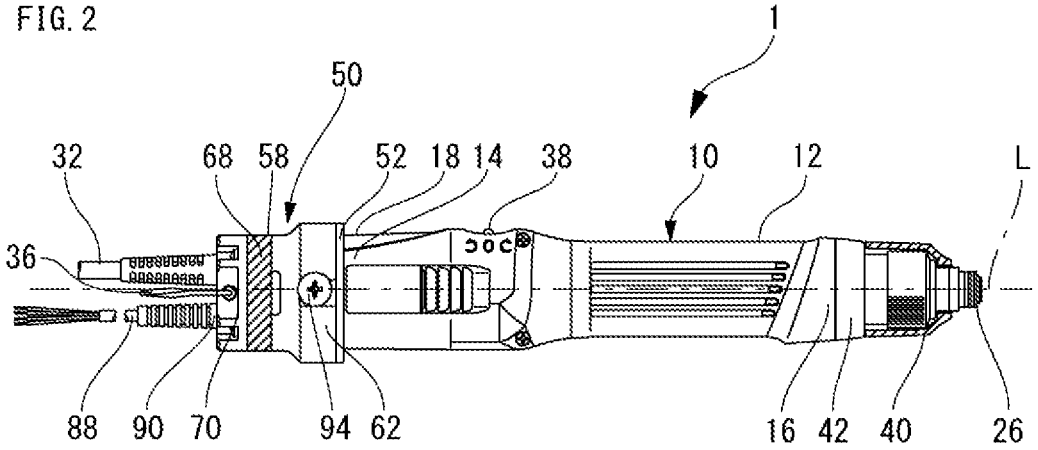
FIG. 2 is a side view of the motor-driven screwdriver with an operation information indicating function shown in FIG. 1.

A motor-driven screwdriver 1 with an operation information indicating function according to the present invention comprises, as shown in FIGS. 1 and 2, a motor-driven screwdriver 10 and a motor-driven screwdriver operation information indicator 50 retrofitted to a rear end portion 14 of the screwdriver 10. The operation information indicator 50 is, as will be explained later, electrically connected to both the screwdriver 10 and an external control circuit (not shown) to receive signals output from the screwdriver 10 and the external control circuit and to visually indicate information related to the operation of the screwdriver 10 through a ring-shaped operation information indicating part (light-transmitting ring) 68.

Figure 3:
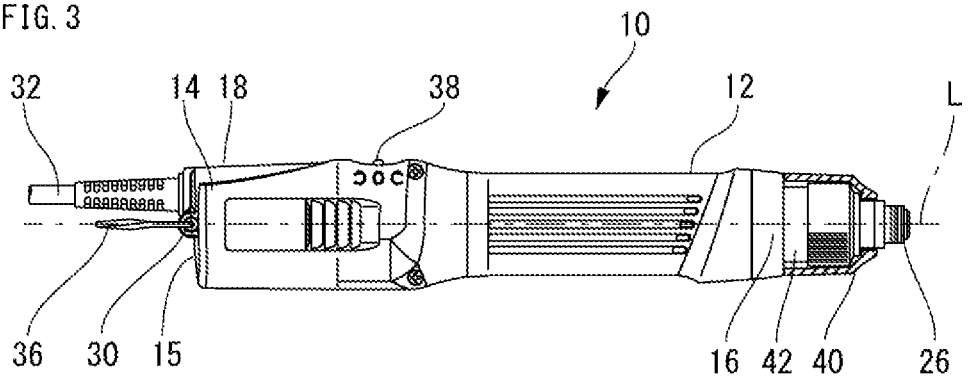
FIG. 3 is a side view of the motor-driven screwdriver before a motor-driven screwdriver operation information indicator is attached thereto.
Figure 4:
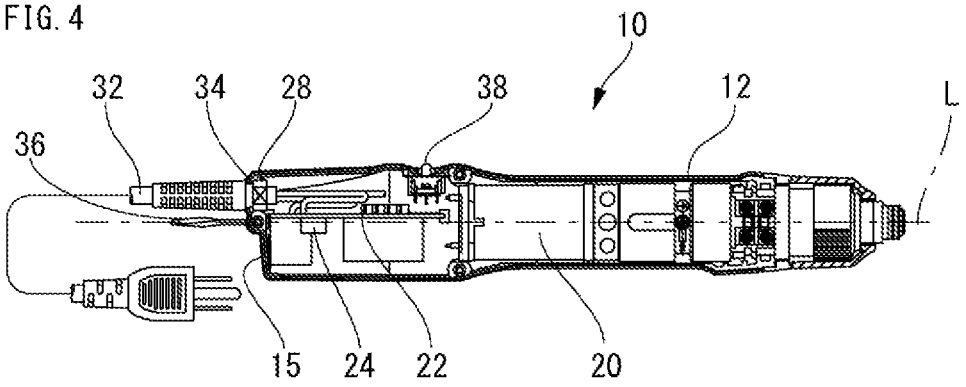
FIG. 4 is a sectional view of the motor-driven screwdriver shown in FIG. 3.

The screwdriver 10, to which the operation information indicator 50 is attachable, has, as shown in FIGS. 3 and 4, a tubular screwdriver housing 12, a motor 20 disposed in the screwdriver housing 12, and a motor-driven screwdriver drive control circuit 22. The screwdriver housing 12 has a front end portion 16 provided therein with a bit holder 26 driven to rotate by the motor 20. The bit holder 26 is configured to be fitted with a screwdriver bit (not shown). The screwdriver housing 12 has a rear end surface 15 formed with a power supply cord holding hole 28 for holding a power supply cord 32. That is, a power supply cord securing annular member 34 secured to the outer periphery of the power supply cord 32 is engagingly secured to the power supply cord holding hole 28, thereby allowing the power supply cord 32 to be held so as not to come out of the screwdriver housing 12. A part of the power supply cord 32 that extends from the drive control circuit 22 to the annular member 34 is folded in the screwdriver housing 12 and thus disposed with a sufficient margin of length. The rear end portion 14 of the screwdriver housing 12 has two suspension holes 30 formed at mutually opposing positions so as to extend inwardly perpendicularly to a longitudinal axis L of the screwdriver housing 12. The two suspension holes 30 are fitted with a suspension hook 36 for suspending the screwdriver 10. The screwdriver housing 12 is further provided with a selector switch 38 to enable the screwdriver 10 to be operated from the outside of the screwdriver housing 12. The selector switch 38 is connected to the drive control circuit 22 to allow the driving direction of the motor 20 to be changed over among "forward", "reverse", and "neutral" by actuating the selector switch 38. The screwdriver 10 is configured such that the motor 20 is driven to rotate when the screwdriver 10 is operated so that a screwdriver bit held by the bit holder 26 is pushed into a screw. When the motor 20 is driven forward, the bit holder 26 rotates in a direction for tightening a right-hand screw; when the motor 20 is driven reversely, the bit holder 26 rotates in a direction for loosening a right-hand screw. When the selector switch 38 is in the neutral position, the motor 20 is not driven.

Figure 5:
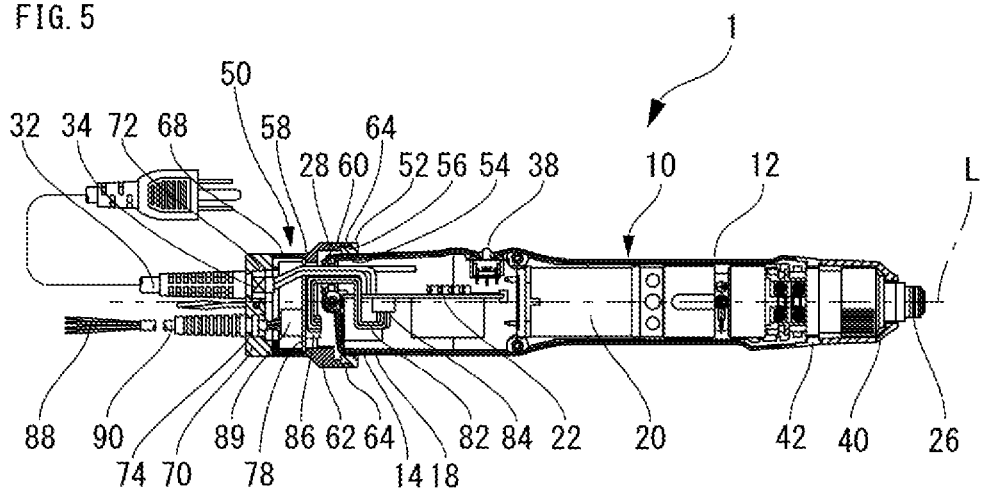
FIG. 5 is a sectional view of the motor-driven screwdriver with an operation information indicating function shown in FIG. 2.
Figure 10:
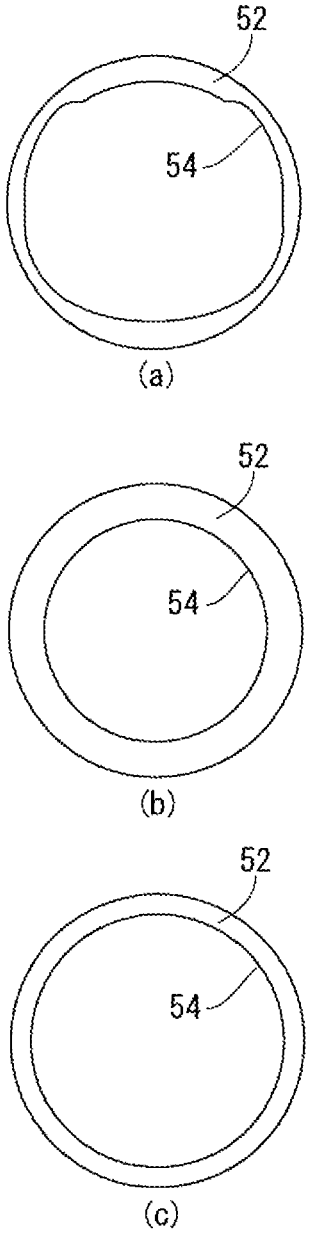
FIG. 10 is a diagram showing supporting and securing members having respective configurations conforming to the outer peripheral surfaces of the rear end portions of the various motor-driven screwdrivers shown in FIG. 8.

The operation information indicator 50, which is retrofitted to the rear end portion 14 of the screwdriver 10 has, as shown in FIGS. 1, 2 and 5, a ring-shaped supporting and securing member 52 secured to an outer peripheral surface 18 of the rear end portion 14 of the screwdriver 10, an indicator housing 58 engagingly secured to the supporting and securing member 52, and an indication control circuit 78 disposed in the indicator housing 58. The supporting and securing member 52 has an inner peripheral surface 54 conforming in shape to the outer peripheral surface 18 of the rear end portion 14 of the screwdriver housing 12 (see FIG. 10), so that no gap will be formed between the inner peripheral surface 54 of the supporting and securing member 52 and the outer peripheral surface 18 of the rear end portion 14 of the screwdriver housing 12 when the supporting and securing member 52 is secured to the screwdriver housing 12, as will be explained later. The supporting and securing member 52 has a supporting and securing part 56 with a stepped configuration formed on the outer peripheral surface thereof. The indicator housing 58 has a securing part 60 with a stepped configuration formed on the inner peripheral surface thereof. The indicator housing 58 and the supporting and securing member 52, which has a ring-like shape, are secured to each other with the securing part 60 of the indicator housing 58 and the supporting and securing part 56 of the supporting and securing member 52 fitted to each other in the axial direction of the supporting and securing member 52.

The indicator housing 58 has a circular cylindrical indicator housing body 62 fitted to the supporting and securing member 52, a light-transmitting ring 68 formed of a light-transmitting transparent material, and a cord holding member 70. The indicator housing 58 is formed by screw-fixing the indicator housing body 62 and the cord holding member 70 to each other with the light-transmitting ring 68 held therebetween, as will be explained later. The indication control circuit 78 is provided with an LED. The LED emits light in response to a signal from the indication control circuit 78. Light from the LED is visible from the outside of the operation information indicator 50 through the light-transmitting ring 68.

Figure 6:
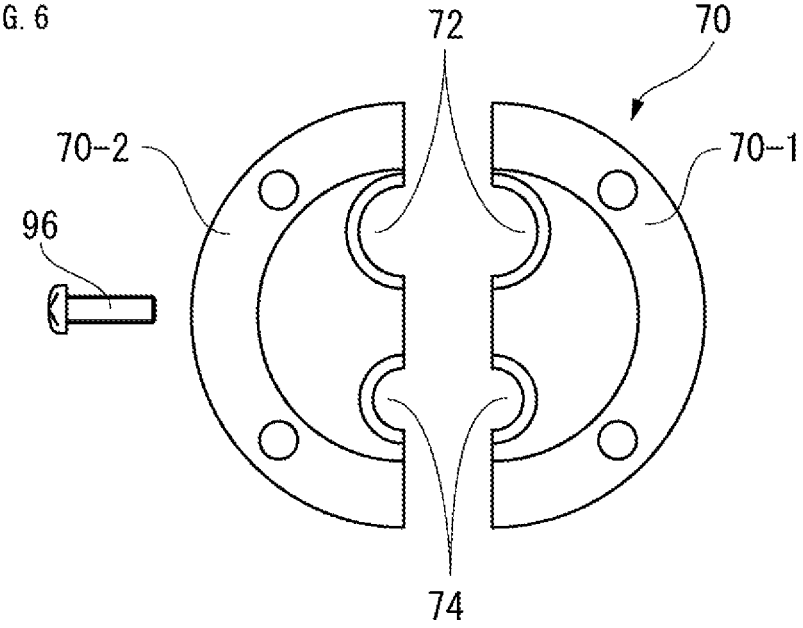
FIG. 6 is a diagram showing a cord holding member.
Figure 7A:
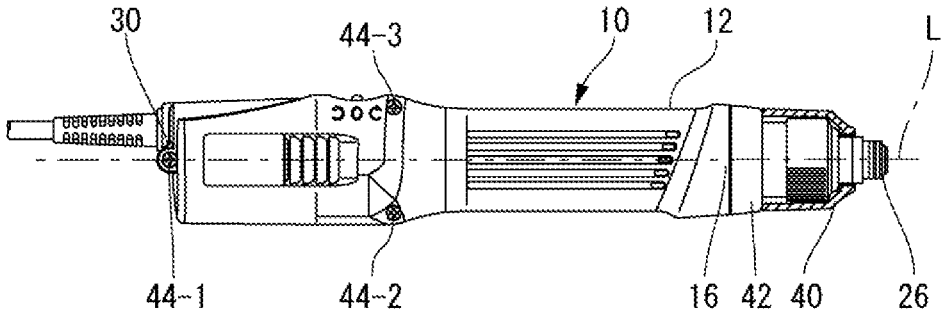
FIG. 7A is a first diagram showing a procedure for attaching a motor-driven screwdriver operation information indicator to a motor-driven screwdriver.
Figure 7B:
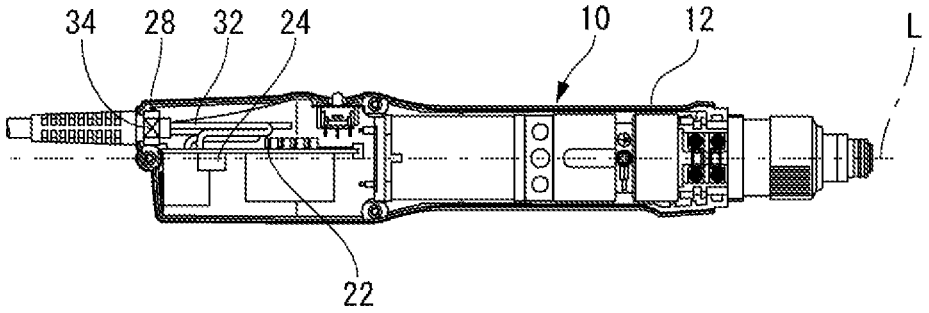
FIG. 7B is a second diagram showing a procedure for attaching a motor-driven screwdriver operation information indicator to a motor-driven screwdriver.
Figure 7C:
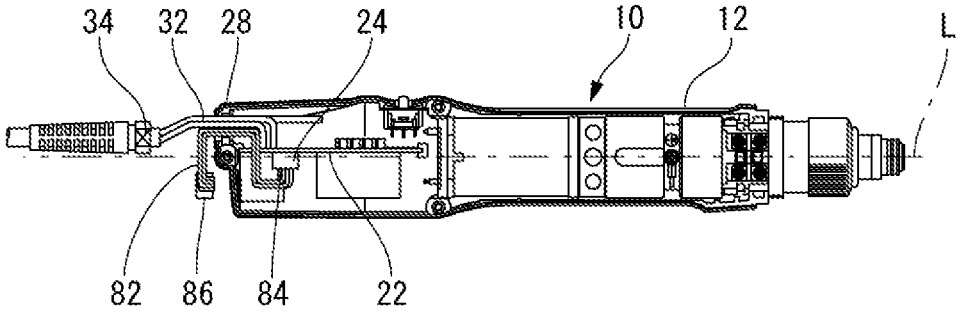
FIG. 7C is a third diagram showing a procedure for attaching a motor-driven screwdriver operation information indicator to a motor-driven screwdriver.
Figure 7D:
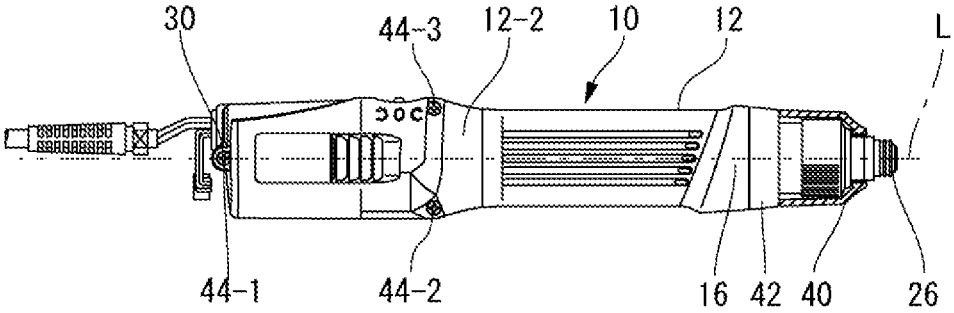
FIG. 7D is a fourth diagram showing a procedure for attaching a motor-driven screwdriver operation information indicator to a motor-driven screwdriver.
Figure 7E:
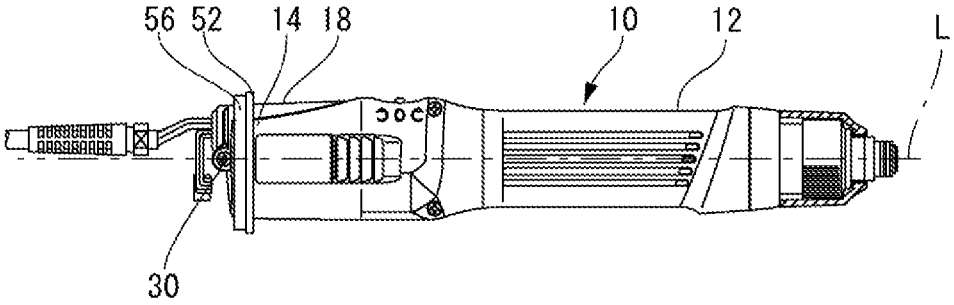
FIG. 7E is a fifth diagram showing a procedure for attaching a motor-driven screwdriver operation information indicator to a motor-driven screwdriver.
Figure 7F:
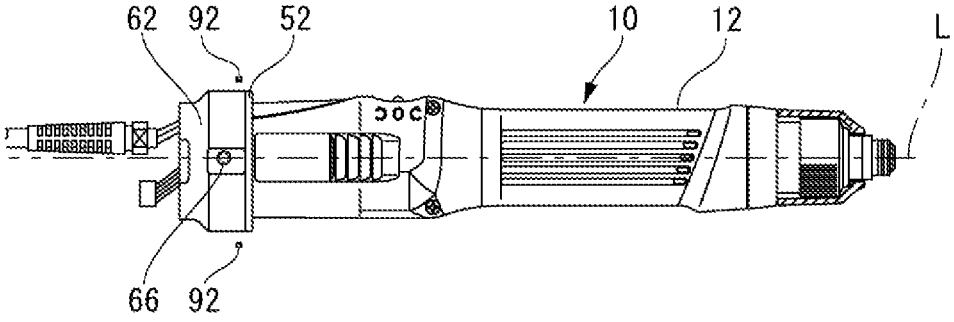
FIG. 7F is a sixth diagram showing a procedure for attaching a motor-driven screwdriver operation information indicator to a motor-driven screwdriver.
Figure 7G:
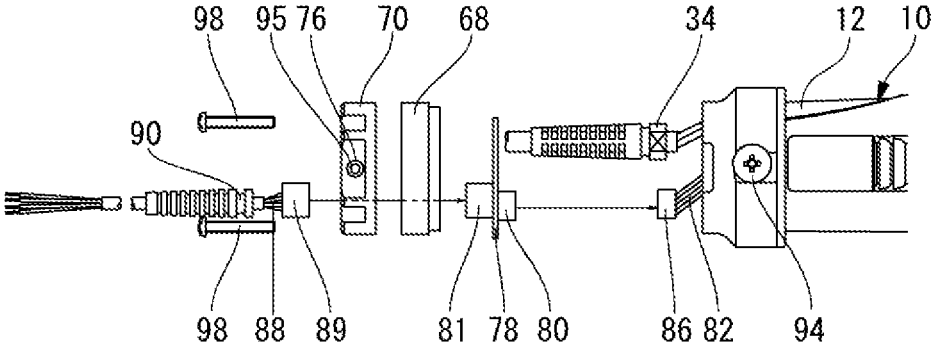
FIG. 7G is a seventh diagram showing a procedure for attaching a motor-driven screwdriver operation information indicator to a motor-driven screwdriver.
Figure 7H:
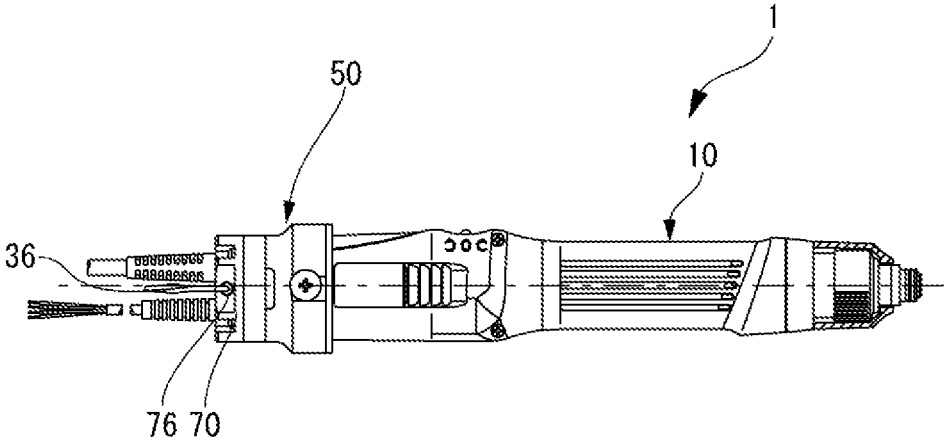
FIG. 7H is an eighth diagram showing a procedure for attaching a motor-driven screwdriver operation information indicator to a motor-driven screwdriver.

When the operation information indicator 50 is retrofitted to the rear end portion 14 of the screwdriver 10, as shown in FIG. 5, the power supply cord securing annular member 34 is detached from the power supply cord holding hole 28 of the screwdriver housing 12 and held by and secured to the cord holding member 70. The cord holding member 70 comprises, as shown in FIG. 6, a first member 70-1 and a second member 70-2. Between the first member 70-1 and the second member 70-2, a power supply cord holding hole 72 is formed. The power supply cord 32 held in the power supply cord holding hole 72 of the cord holding member 70 extends, as shown in FIG. 5, from the drive control circuit 22 in the screwdriver housing 12 through the power supply cord holding hole 28 in the screwdriver housing 12 and through the indicator housing 58. The drive control circuit 22 is provided with a signal output terminal 24 (FIG. 7B) for outputting a signal related to an operation of the screwdriver 10. On the other hand, the indication control circuit 78 is provided with an internal signal input terminal 80 (FIG. 7G) for receiving a signal from the screwdriver 10. Internal signal transmission wiring 82 connects between the signal output terminal 24 of the drive control circuit 22 and an internal signal input terminal 80 of the indication control circuit 78. The internal signal transmission wiring 82 is wired to extend through the power supply cord holding hole 28 in which a gap is formed as a result of the removal of the power supply cord securing annular member 34. The indication control circuit 78 is further provided with an external signal input terminal 81 (FIG. 7G), to which is connected external signal transmission wiring 88 for transmitting an external signal from the external control circuit. The external signal transmission wiring 88 has a transmission wiring securing annular member 90 secured to the outer periphery thereof. The annular member 90 is secured and held in a transmission wiring holding hole 74 (FIG. 6) formed between the first and second members 70-1 and 70-2 of the cord holding member 70, thus the external signal transmission wiring 88 being held.

The motor-driven screwdriver drive control circuit 22 has a function of outputting from the signal output terminal 24 signals related to the operation of the screwdriver 10, for example, signals indicating the following: the on/off status of the motor 20; the driving direction of the motor 20, i.e. "forward", "reverse", or "neutral", set through the selector switch 38; the completion of screw tightening; and the temperature of the motor 20. The external control circuit has a function of outputting an external signal, for example, a signal indicating which of a plurality of motor-driven screwdrivers connected to the external control circuit should be used, or a signal indicating which motor-driven screwdriver is usable. The indication control circuit 78 of the motor-driven screwdriver operation information indicator 50 receives the above-described signals from the motor-driven screwdriver drive control circuit 22 and the external control circuit and indicates information related to the operation of the screwdriver 10 according to the received signals for the operator by emitting the LED. Examples of information related to the operation of the screwdriver 10 include the following: information indicating that the screwdriver 10 is usable; information indicating the operating status of the screwdriver 10; information indicating the timing of inspection and repair of the screwdriver 10; and information indicating a state where the screwdriver 10 has been forcibly stopped. The information indicating that the screwdriver 10 is usable is indicated based on a signal transmitted from the external control circuit. The information indicating the operating status specifically includes information indicating that the rotational drive of the bit holder 26 has been temporarily stopped due to the application of a specified torque to the bit holder 26 and hence screw tightening with a specified torque has been normally completed, and information indicating the status of the driving direction of the motor 20, i.e. "forward", "reverse", or "neutral", set on the selector switch 38. The information indicating the timing of inspection and repair is indicated, for example, on the following occasions: when the number of times of completion of screw tightening integrated from the start of use of the screwdriver 10 reaches a value greater than a specified value; when, in a case where the motor 20 of the screwdriver 10 is a brush motor, the brush of the brush motor has worn to a value less than a specified value; and when the motor 20 does not stop even when a specified torque is applied to the bit holder 26 and hence the rotational drive of the bit holder 26 does not stop. The information indicating the fact that the screwdriver 10 has been forcibly stopped is indicated, for example, when it is judged necessary to cool the motor 20 due to the fact that the temperature of the motor 20 has risen to a level higher than a predetermined value.

In this embodiment, lighting/blinking of an LED is used as an operation information indicating method, but operation information may be indicated by using a display capable of displaying letters in place of the lighting/blinking of an LED. In the alternative case, numerical values may be used to indicate the number of times at which screw tightening is normally completed, or to indicate the integrated value of the driving time of the motor 20, etc. as information related to the operation of the screwdriver 10. Alternatively, the above-described information to be informed to the operator may be indicated by using letters.

It should be noted that the number of pieces of information indicatable on the motor-driven screwdriver operation information indicator 50 is not necessarily limited to one and that a plurality of pieces of information may be indicated simultaneously, for example, by providing the operation information indicator 50 with a plurality of LEDs of different colors. In addition, the operation information indicator 50 is configured to enable the user to select and set information to be indicated according to his or her demand.

The indication control circuit 78 may have not only a function of transmitting signals related to the operation of the screwdriver 10 but also a recording device for storing signals received from the motor-driven screwdriver drive control circuit 22 and the external control circuit as data and also a USB terminal or the like as a data output terminal for transferring the stored data to the outside. By taking out and analyzing the stored data, it is possible to supervise whether or not the operator is working efficiently. Specifically, when the number of times at which the motor 20 is driven reversely is large, the possibility is high that screw retightening has been performed many times; therefore, it is possible to judge that there have been a large number of errors in screw tightening. When the driving time of the motor 20 is long, it is possible to judge that the motor 20 has been uselessly driven for a long time. It is also possible to judge that the timing of adjustment and repair of the screwdriver 10 is approaching, and hence possible to prepare a motor-driven screwdriver 10 for replacement in advance of the timing of adjustment and repair. It should be noted that setting as to which information is to be indicated on the above-described motor-driven screwdriver operation information indicator 50 can be made by connecting a computer to the above-described USB terminal and changing the setting on the indication control circuit 78 from the computer.

The cord holding member 70 of the indicator housing 58 has two mutually facing suspension holes 76 (see FIG. 7G) extending from the respective outer peripheral surfaces of the first and second members 70-1 and 70-2 inwardly perpendicularly to the longitudinal axis L. The two suspension holes 76 are fitted with the suspension hook 36, which has been detached from the screwdriver 10. The bottom surface of each of the suspension holes 76, which are fitted with the suspension hook 36, is provided with a threaded hole 95 extending toward the center of the cord holding member 70 to receive a screw 96 for connecting the first and second members 70-1 and 70-2 to each other.

Next, a procedure for retrofitting the motor-driven screwdriver operation information indicator 50 to the motor-driven screwdriver 10 will be explained with reference to FIGS. 7A to 7H. First, the suspension hook 36 (see FIG. 4) attached to the rear end portion 14 of the screwdriver 10 is removed from the suspension holes 30. Further, a circular cylindrical cover 40 and a coupling 42 are detached from the front end portion 16 of the screwdriver 10, and three screws 44-1, 44-2 and 44-3 connecting first and second housing members 12-1 and 12-2 (see FIG. 1), which constitute the screwdriver housing 12, are removed (see FIG. 7A) to detach the second housing member 12-2 from the first housing member 12-1 (see FIG. 7B). It should be noted that a threaded hole that receives the screw 44-1 is provided to extend from the bottom surface of each of the suspension holes 30, in which the suspension hook 36 is fitted, toward the center of the screwdriver housing 12. Next, the power supply cord securing annular member 34 is disengaged from the power supply cord holding hole 28 in the screwdriver housing 12, and the part of the power supply cord 32 which has been folded in the screwdriver housing 12 is pulled out from the power supply cord holding hole 28. In addition, a first end portion 84 of the internal signal transmission wiring 82 is connected to the signal output terminal 24 of the motor-driven screwdriver drive control circuit 22, and the internal signal transmission wiring 82 is disposed to extend through the power supply cord holding hole 28 (see FIG. 7C). The detached second housing member 12-2 is reattached to the first housing member 12-1, and the first and second housing members 12-1 and 12-2 are connected and secured to each other with the three screws 44-1, 44-2 and 44-3 (see FIG. 7D). Next, the ring-shaped supporting and securing member 52 is press-fitted and secured to the outer peripheral surface 18 of the rear end portion 14 of the screwdriver housing 12 (see FIG. 7E). The supporting and securing member 52 is secured to the screwdriver housing 12 with substantially no gap between the inner peripheral surface 54 of the supporting and securing member 52 and the outer peripheral surface 18 of the screwdriver housing 12 because the inner peripheral surface 54 of the supporting and securing member 52 conforms in shape to the outer peripheral surface 18 of the screwdriver housing 12. It should be noted that the screwdriver housing 12 and the supporting and securing member 52 may be secured to each other by using an adhesive. Next, the indicator housing body 62 is attached to the supporting and securing member 52 so that securing part 60 of the indicator housing body 62 is axially fitted to the supporting and securing part 56 of the supporting and securing member 52 (see FIG. 7F). The securing part 60 of the indicator housing body 62 is provided with two threaded holes 64 (see FIG. 5) extending from the outer peripheral surface of the securing part 60 to the inner peripheral surface thereof. The indicator housing 58 and the supporting and securing member 52 are secured to each other by engaging setscrews 92 with the threaded holes 64. The indicator housing body 62 further has two threaded holes 66 provided at respective positions corresponding to the suspension holes 30 of the screwdriver housing 12 such that the threaded holes 66 extend from the outer peripheral surface of the indicator housing body 62 to the inner peripheral surface thereof. Connecting members 94 (see FIG. 7G) having external threads, respectively, are engaged with the threaded holes 66 so as to project from the inner peripheral surface of the indicator housing body 62 and to extend into the suspension holes 30 of the screwdriver housing 12. With the connecting members 94, the indicator housing body 62 is connected to and supported by the screwdriver housing 12 and held so as not to come off the motor-driven screwdriver 10. Next, a second end portion 86 of the internal signal transmission wiring 82 extending out of the screwdriver housing 12 is connected to the internal signal input terminal 80 of the indication control circuit 78 (see FIG. 7G). Further, a connecting terminal 89 of the external signal transmission wiring 88 is passed through the inside of the light-transmitting ring 68 and connected to the external signal input terminal 81 of the indication control circuit 78. Next, the first and second members 70-1 and 70-2 of the cord holding member 70 (see FIG. 6) are connected and secured to each other by engaging the screw 96 with the threaded hole 95, with the power supply cord securing annular member 34 and the transmission wiring securing annular member 90 held in the power supply cord holding hole 72 and the transmission wiring holding hole 74, respectively. The connected and secured cord holding member 70 is secured to the indicator housing body 62 by using screws 98, with the indication control circuit 78 and the light-transmitting ring 68 held between the cord holding member 70 and the indicator housing body 62. Finally, the suspension hook 36 is attached to the suspension holes 76, thereby completing the operation of attaching the motor-driven screwdriver operation information indicator 50 to the motor-driven screwdriver 10 (see FIG. 7H).

Thus, the motor-driven screwdriver operation information indicator 50 can be retrofitted to an existing motor-driven screwdriver 10 without applying additional work to the screwdriver 10. In addition, assuming that the operation information indicator 50 will be attached to the screwdriver 10, the power supply cord 32 is disposed in such a manner as to be folded in the screwdriver housing 12 so that, when pulled out of the screwdriver housing 12, the power supply cord 32 has a sufficient length to allow the power supply cord securing annular member 34 to be moved to the power supply cord holding hole 72 of the indicator housing 58. Accordingly, when attaching the operation information indicator 50 to the screwdriver 10, there is no need for an operation such as replacing the power supply cord 32 with another or extending the length of the power supply cord 32.

Figure 8:
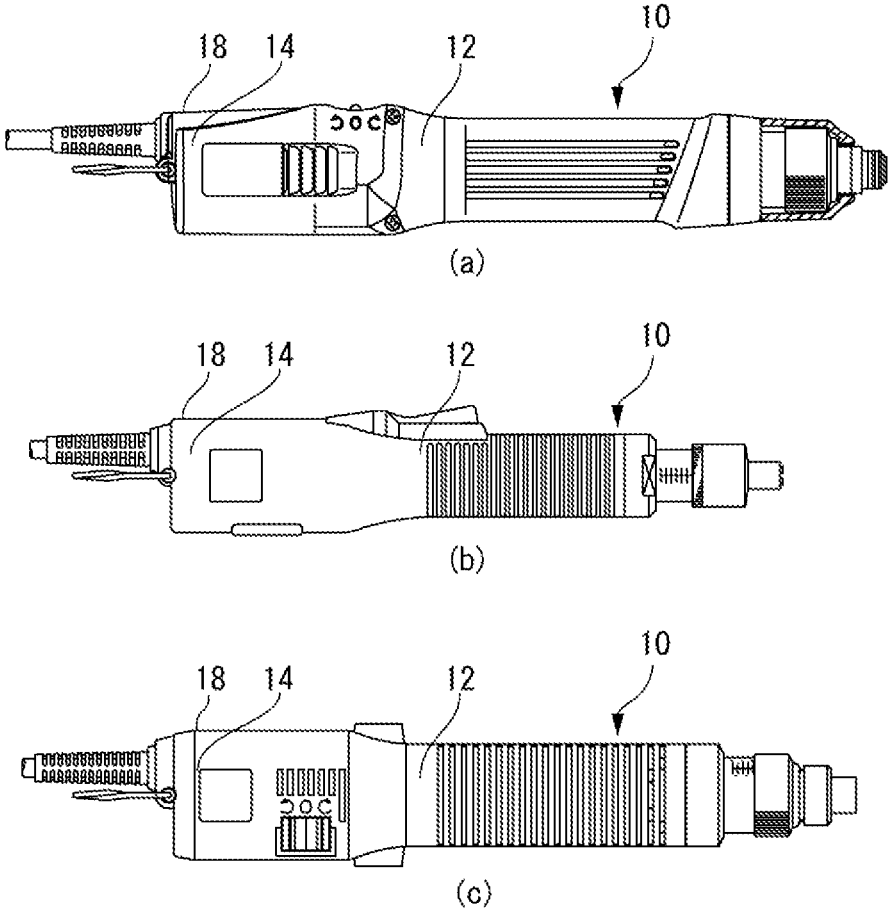
FIG. 8 is a diagram showing various motor-driven screwdrivers.
Figure 9:
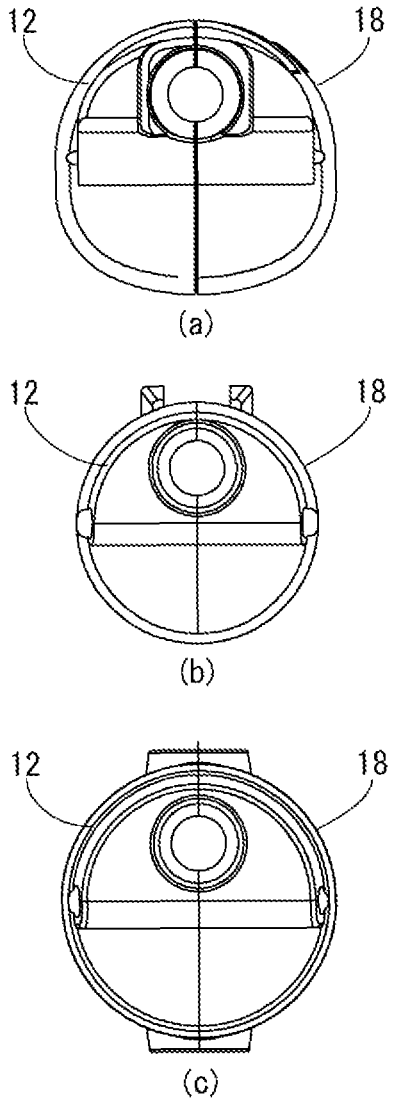
FIG. 9 is a sectional view of the rear end portions of the various motor-driven screwdrivers shown in FIG. 8.

Existing motor-driven screwdrivers 10 vary in size and shape as shown, for example, in FIGS. 8*a* to 8*c*. Accordingly, the outer peripheral surface 18 of the rear end portion 14 of the screwdriver housing 12 also varies in size and shape as shown, for example, in FIGS. 9*a* to 9*c*. Therefore, in order to retrofit an indicator, a plurality of indicator bodies usually need to be prepared in conformity with various configurations of motor-driven screwdrivers. In the motor-driven screwdriver operation information indicator 50 according to the present invention, however, the supporting and securing member 52, which is engagingly secured directly to the outer peripheral surface 18 of the motor-driven screwdriver 10, is a member separate from the indicator housing 58. Therefore, the indicator housing 58 can be used in common for motor-driven screwdrivers 10 of different configurations, provided that supporting and securing members 52 are prepared which have inner peripheral surfaces 54 conforming in shape to the outer peripheral surfaces 18 of various motor-driven screwdrivers as shown in FIGS. 10*a* to 10*c*. Thus, the motor-driven screwdriver operation information indicator 50 of the present invention can be retrofitted to various motor-driven screwdrivers 10 different in the shape of their outer peripheral surfaces 18 by only preparing supporting and securing members 52, which are relatively simple in structure, in conformity with the motor-driven screwdrivers 10.

In the above-described embodiment, an LED, which is a light-emitting display element, is used as an operation information indicating part indicating information related to the operation of the screwdriver 10, thereby visually indicating the information. It should, however, be noted that the operation information indicating part may comprise other light-emitting display elements. It is also possible to use audio indications. Further, although the indication control circuit 78 is connected to both the motor-driven screwdriver drive control circuit 22 and the external control circuit, the indication control circuit 78 may be connected to only one of them. Further, the supporting and securing member 52 need not necessarily have a ring shape. The supporting and securing member 52 may have any shape that can securely support the indicator housing 58. The supporting and securing member 52 may be formed as a member integrated with the screwdriver housing 12. Alternatively, the supporting and securing member 52 may be formed as a member integrated with the indicator housing body 62.

Although in the above-described embodiment the supporting and securing member 52 is secured to the outer peripheral surface 18 of the screwdriver housing 12 by press-fitting, the supporting and securing member 52 need not necessarily be firmly secured to the outer peripheral surface 18 of the screwdriver housing 12 because the indicator housing 58, which is secured to the supporting and securing member 52, is supported by the connecting members 94 so as not to come off the screwdriver housing 12. The supporting and securing member 52 may be configured to only engage the outer peripheral surface 18 of the screwdriver housing 12 so that the indicator housing 58 will not tilt about an axis defined by the connecting members 94.

LIST OF REFERENCE SIGNS

Motor-driven screwdriver 1 with operation information indicating function; motor-driven screwdriver 10; screwdriver housing 12; first housing member 12-1; second housing member 12-2; rear end portion 14; rear end surface 15; front end portion 16; outer peripheral surface 18; motor 20; motor-driven screwdriver drive control circuit 22; signal output terminal 24; bit holder 26; power supply cord holding hole 28; longitudinal axis L; suspension holes 30; power supply cord 32: power supply cord securing annular member 34; suspension hook 36; selector switch 38; cover 40; coupling 42; screws 44; motor-driven screwdriver operation information indicator 50; supporting and securing member 52; inner peripheral surface 54; supporting and securing part 56; indicator housing 58; securing part 60; indicator housing body 62; threaded holes 64; threaded holes 66; operation information indicating part, light-transmitting ring 68; cord holding member 70; first member 70-1; second member 70-2; power supply cord holding hole 72; transmission wiring holding hole 74; suspension holes 76; indication control circuit 78; internal signal input terminal 80; external signal input terminal 81; internal signal transmission wiring 82; first end portion 84; second end portion 86; external signal transmission wiring 88; connecting terminal 89; transmission wiring securing annular member 90; setscrews 92; connecting members 94; threaded hole 95; screw 96; screws 98.

The invention claimed is:

1. A motor-driven screwdriver operation information indicator retrofittable to a screwdriver housing of a motor-driven screwdriver to indicate information related to an operation of the motor-driven screwdriver, the motor-driven screwdriver operation information indicator comprising:

a supporting and securing member configured to be secured to an outer surface of a rear end portion of the screwdriver housing;

an indicator housing having a securing part to be secured to a supporting and securing part provided on the supporting and securing member, the indicator housing being held at a rear position of the rear end portion of the screwdriver by securing the securing part to the supporting and securing part;

an indication control circuit disposed in the indicator housing, the indication control circuit being connected to at least one circuit selected from between a motor-driven screwdriver drive control circuit disposed in the screwdriver housing and an external control circuit outside the screwdriver housing to transmit a signal related to an operation of the motor-driven screwdriver on a basis of a signal received from the at least one circuit; and an operation information indicating part receiving the signal related to the operation of the motor-driven screwdriver, which is transmitted from the indication control circuit, and to indicate information related to the operation of the motor-driven screwdriver.

2. The motor-driven screwdriver operation information indicator of claim 1, wherein the supporting and securing member has a ring-like shape covering the outer surface of the screwdriver housing.

3. The motor-driven screwdriver operation information indicator of claim 2, wherein an inner peripheral surface of the supporting and securing member is formed to conform in shape to the outer surface of the screwdriver housing.

4. The motor-driven screwdriver operation information indicator of claim 2, wherein the securing part of the indicator housing and the supporting and securing part of the supporting and securing member are fitted to each other in an axial direction of the supporting and securing member.

5. The motor-driven screwdriver operation information indicator of claim 1, wherein the rear end portion of the screwdriver housing is provided with a suspension hole for suspending the motor-driven screwdriver;

the indicator housing having a through-hole extending through the indicator housing from an outer peripheral surface to an inner peripheral surface thereof;

the motor-driven screwdriver operation information indicator further comprising:

a connecting member inserted into the suspension hole through the through-hole to connect together the indicator housing and the rear end portion of the screwdriver housing.

6. The motor-driven screwdriver operation information indicator of claim 5, wherein the through-hole of the indicator housing has an internal thread, and the connecting member is an externally threaded member engageable with the internal thread.

7. The motor-driven screwdriver operation information indicator of claim 1, wherein the indicator housing has a suspension hole for securing a suspension hook.

8. The motor-driven screwdriver operation information indicator of claim 1, wherein the operation information indicating part has a light-emitting display element that emits light upon receiving the signal related to the operation of the motor-driven screwdriver from the indication control circuit.

9. The motor-driven screwdriver operation information indicator of claim 1, wherein the information related to the operation of the motor-driven screwdriver is at least one of following information:

information indicating that the motor-driven screwdriver is usable, which is based on a signal transmitted from the external control circuit;

information indicating an operating status of the motor-driven screwdriver;

information indicating timing of inspection and repair of the motor-driven screwdriver; and information indicating a state where the motor-driven screwdriver has been forcibly stopped.

10. The motor-driven screwdriver operation information indicator of claim 1, wherein the indication control circuit has a recording device for recording the signal received, which is related to the operation of the motor-driven screwdriver, and a data output terminal for transferring data represented by the signal recorded in the recording device to an outside.

11. The motor-driven screwdriver operation information indicator of claim 1, wherein the indication control circuit is connectable to the motor-driven screwdriver drive control circuit;

the motor-driven screwdriver operation information indicator further comprising:

internal signal transmission wiring connected at one end thereof to the indication control circuit, the internal signal transmission wiring having an other end connectable to the motor-driven screwdriver drive control circuit.

12. A motor-driven screwdriver with an operation information indicating function, comprising:

a motor-driven screwdriver; and the motor-driven screwdriver operation information indicator of claim 1 retrofitted to the screwdriver housing of the motor-driven screwdriver.

13. The motor-driven screwdriver of claim 12, further comprising a power cord, wherein, when the motor-driven screwdriver operation information indicator is not retrofitted to the motor-driven screwdriver, the power supply cord has a portion accommodated in a folded state in the screwdriver housing and extends rearward from the rear end portion of the screwdriver housing, whereas when the motor-driven screwdriver operation information indicator is retrofitted to the motor-driven screwdriver, the power supply cord extends rearward through the motor-driven screwdriver operation information indicator, with the folded portion of the power supply cord unfolded and extended rearward.

* * * * *